US006443090B1

(12) United States Patent
Giffin et al.

(10) Patent No.: US 6,443,090 B1
(45) **Date of Patent: *Sep. 3, 2002**

(54) CAMPER BOAT ASSEMBLY

(75) Inventors: Jeffery J. Giffin, 908 Aspen Rd., Kohler, WI (US) 53044; Allen J. Lysne, P.O. Box 407, Owatoma, MN (US) 55060; Terry Burk, Winter Springs, FL (US); Edward J. Erskine, Benson, NY (US); Michael Mathewson, Elk River, MN (US); Kevin Owens, Sanford, FL (US); Robert R. Shearer, Ellenton, FL (US); Kevin Stancil, Bradenton, FL (US)

(73) Assignees: Jeffery J. Giffin, Kohler, WI (US); Allen J. Lysne, Owatoma, MN (US); Nelson A. Taylor Co., Inc., Gloversville, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/925,621

(22) Filed: Aug. 10, 2001

Related U.S. Application Data

(63) Continuation-in-part of application No. 09/374,039, filed on Aug. 13, 1999, now Pat. No. 6,286,449.

(51) Int. Cl.[7] ..... B63B 17/00; B63B 17/02
(52) U.S. Cl. ..... 114/361
(58) Field of Search ..... 114/351, 361; 135/88.01, 88.13

(56) References Cited

U.S. PATENT DOCUMENTS

| | | | | |
|---|---|---|---|---|
| 2,816,297 A | | 12/1957 | Stanley | |
| 3,572,353 A | | 3/1971 | Pinkley | |
| 3,955,228 A | | 5/1976 | Gaschenko et al. | |
| 4,075,723 A | | 2/1978 | Bareis et al. | |
| 4,657,299 A | | 4/1987 | Mahan | |
| 4,671,203 A | | 6/1987 | Sanburg | |
| 4,766,830 A | | 8/1988 | Kunz | |
| 4,951,594 A | | 8/1990 | Feikema | |
| 4,979,457 A | | 12/1990 | Sommerhauser et al. | |
| 5,088,438 A | | 2/1992 | Richardson, Jr. et al. | |
| 5,339,851 A | | 8/1994 | Miller et al. | |
| 5,441,066 A | * | 8/1995 | Harris | 135/88.01 |
| 5,479,872 A | | 1/1996 | Hulett | |
| 5,927,311 A | | 7/1999 | Jager | |
| 6,129,034 A | | 10/2000 | Santa Cruz et al. | |
| 6,286,449 B1 | | 9/2001 | Giffin et al. | |

FOREIGN PATENT DOCUMENTS

WO WO 94/06676 3/1994

* cited by examiner

*Primary Examiner*—S. Joseph Morano
*Assistant Examiner*—Andrew Wright
(74) *Attorney, Agent, or Firm*—Nixon & Vanderhye P.C.

(57) ABSTRACT

A camper back assembly for attachment to a boat includes a plurality of strut members having one end anchored to the boat, with the end opposite ends of the strut members anchored to the awning or boat structure. The length of the strut members is greater than the linear distance between the anchor points on the boat transom and the awning to provide a dome-like support for a cover portion which is releaseably secured to the boat.

12 Claims, 5 Drawing Sheets

CAMPER BOAT ASSEMBLY

CROSS-REFERENCES TO RELATED APPLICATIONS

This application is a continuation-in-part of U.S. patent application Ser. No. 09/374,039 filed Aug. 13, 1999, now U.S. Pat. No. 6,286,449 the entire content of which is hereby incorporated by reference.

STATEMENT REGARDING FEDERALLY SPONSORED RESEARCH OR DEVELOPMENT (NOT APPLICABLE)

BACKGROUND OF THE INVENTION

The present invention relates to a camper back boat assembly which may be readily secured to a boat to protect the occupants from inclement weather.

At the present time, camper back cover structures exist for the attachment to power boats and other boats to enclose the rear portion of the boat from inclement weather. These camper back structures require a supporting hardware which is permanently attached to the power boat to provide the support for the canvas roof covering portion. However, when the prior art camper back structures are not in use, the supporting hardware necessarily remains permanently attached to the boat. Also, if it is desired to remove the supporting hardware from the boat, the use of glass fibers to repair the boat hull is required. Thus, existing camper back cover structures are permanently mounted to the boat hull. Also, the existing camper back structures, when not in use, either obstruct the usage of the boat or require hinged mountings which permits the supporting frame hardware to be collapsed to nest along the sides and rear of the boat. Such nesting occupies significant space and substantially reduces the useful space within the boat.

Another disadvantage of existing camper back structures is that they include significant multiple pieces of canvas which must be rolled and stored within the boat. And, because existing camper back structures require the supporting hardware to be permanently attached to the boat, such structures provide an area which is unsightly and provide supporting hardware which is noisy when the boat is in use. Finally, existing permanent stainless steel supporting structures lower and reduce the amount of headroom available for the occupants in the boat.

Typical cover structures additionally have been primarily limited to covering the back or transom of the boat, thereby limiting potentially useful space. Moreover, existing cover structures have not been suitable for other vehicles such as golf carts and the like or for use independently as a stand-alone unit.

BRIEF SUMMARY OF THE INVENTION

It is one object of the present invention to provide a camper back assembly which is engageable with the back or transom of a boat and the existing awning structure on the boat and which does not require fixed anchoring mountings to the boat deck or hull.

A further object of the present invention is to provide a camper back assembly which is significantly less time consuming to install to provide quicker protection from the elements than existing camper back structures.

A further object of the present invention is a camper back assembly which is less costly, which is easier to store and which does not require permanent hardware to be affixed to a boat hull to anchor the camper back assembly.

Still a further object of the present invention is a camper back assembly which eliminates the need for permanent hardware for attachment to the boat while providing increased headroom for the occupants of the boat.

It is yet another object of the present invention to provide a camper back assembly which is releaseably mounted to the boat transom and to the existing boat framework or awning structure.

Finally, it is an object of the present invention to provide a camper back assembly which is inexpensive, which contains less parts and which is significantly easier to install to a boat and remove from the boat than existing camper back assemblies.

The present invention relates to a camper back assembly which is readily mountable to a boat hull to permit rapid installation without the requirement of the use of mounting frames or hardware permanently secured to the boat hull. The camper back assembly of the present invention consists of a covering portion which is structurally arranged to be releaseably secured to the boat hull using the existing snap members that are present on the boat hull.

The camper back assembly further includes a plurality of flexible struts or frame members having one end releaseably secured to the rear or transom of a boat by anchoring the one ends to the covering portion secured to the boat hull and the ends of the strut opposite the one end being releaseably secured to the existing awning secured to the boat. Importantly, the length of the flexible struts is greater than the planar distance between the anchor or securing sites on the boat transom and awning structure. The flexible struts form and define an arch or dome shell which supports the covering portion to provide a protective shell or dome over the covered area.

Preferably, the side and rear edges of the covering portion are releaseably secured to the boat by snap members to provide the protective shell or domed cover over the enclosed area. The front edge of the covering portion is, preferably, releaseably secured to the existing awning structure mounted to the boat to complete the domed enclosure. The flexible struts may be disassembled to permit portability of the camper back assembly. One advantage of the camper back assembly in accordance with the present invention is that the assembly affords significantly more standing headroom in the boat than existing coverings, and this extra headroom permits people to sit or stand in the back of the boat while the camper back is mounted on the boat.

Additionally, the present invention provides a camper back assembly which eliminates the need for a permanent framework to be attached or anchored to the boat and permits the use of a camper back assembly which is significantly less time consuming in assembly, thereby providing quicker protection to the occupants from inclement weather. Also, the camper back assembly in accordance with the present invention may be readily stored within a convenient carrying bag which permits significant savings of boat storage space.

In an alternative strut support structure in accordance with the present invention, the strut support structure utilizes an auxiliary support rod member which is structurally arranged and mounted to extend across the width of the boat under the awning member. The strut support structure is readily affixed to the existing canvas support framework or radar arch. The ends of the flexible strut members are anchored to the auxiliary support rod member and to the transom of the boat.

The ends of the strut may be anchored in pockets in the existing awning structure and in pockets in the rear portion of the covering portion. The covering portion is then secured to the boat in the same manner as the first embodiment, as previously described.

The present invention consists of certain novel features and structural details hereinafter fully described, illustrated in the accompanied drawings, and specifically pointed out in the appended claims, it being understood that various changes in the details may be made without departing from the spirit or sacrificing any of the advantages of the present invention.

BRIEF DESCRIPTION OF THE DRAWINGS

These and other aspects and advantages of the present invention will be described in detail with reference to the accompanying drawings, in which.

DETAILED DESCRIPTION OF PREFERRED EMBODIMENTS

Figure 1:
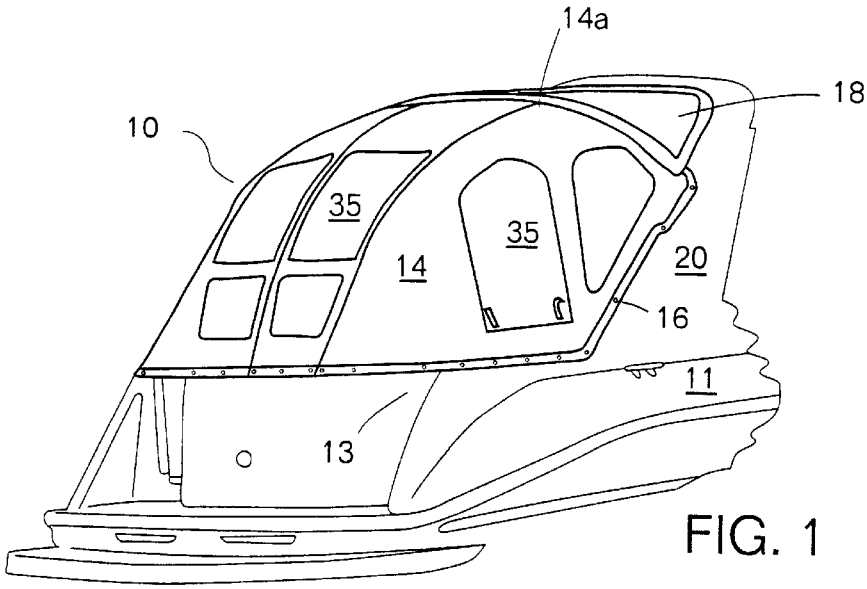
FIG. 1 is a perspective view of the camper back assembly attached to a boat in accordance with the present invention.
Figure 2:
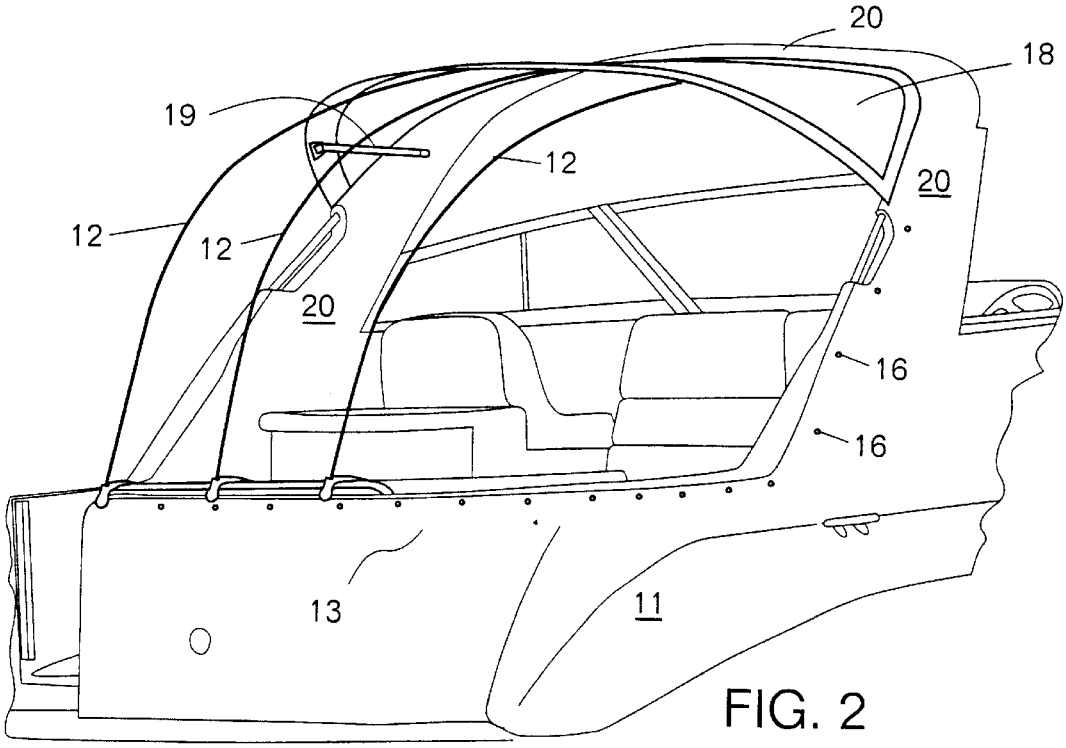
FIG. 2 is a perspective view illustrating the camper back strut members secured to the transom of the boat and the awning for supporting the camper back covering portion in accordance with the present invention.
Figure 3:
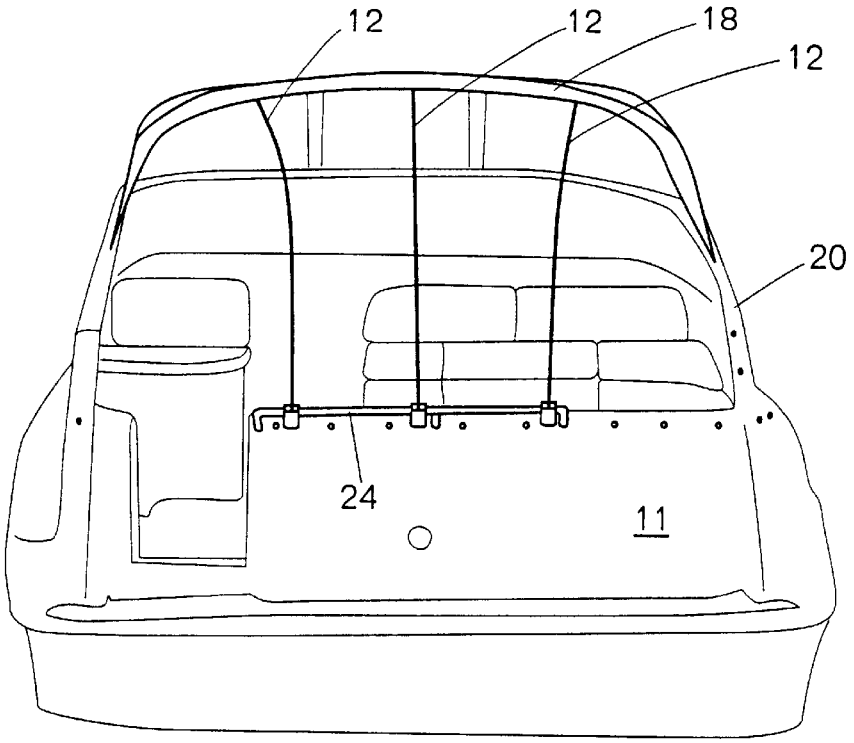
FIG. 3 is a rear view of the camper back strut members mounted for releasable attachment to the boat transom in accordance with the present invention.
Figure 10:
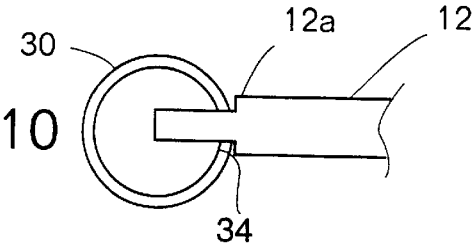
FIG. 10 is a cross-sectional view illustrating the anchoring of the upper ends of the camper back strut members to the auxiliary support frame member in accordance with the present invention.
Figure 11:
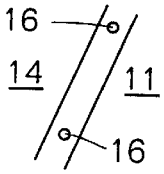
FIG. 11 is an enlarged view illustrating the securing of the cover portion by snap members to the boat hull in accordance with the present invention.

Referring now to the drawings wherein like numerals have been used throughout the several views to designate the same or similar parts, the present invention is directed to a camper back assembly 10 which is readily attachable to a boat deck or hull or other structure. As shown in FIGS. 1–3, the camper back assembly 10 is comprised of a plurality of support strut or frame members 12 which are adapted to support a canvas or water repellant covering portion 14. The covering portion 14, as shown in FIGS. 1, 2 and 10, is structurally arranged to be mounted to snaps 16 that exist on the boat hull 11 to facilitate securing of the canvas covering 14 to the boat. In one embodiment of the present invention, the front edge portion 14*a* of the cover portion 14 is adapted to be secured to the bimini awning 18 which is fixedly secured by support members 19 to the radar arch or support frame 20 of a boat hull 11, as shown in FIGS. 1, 2 and 4.

Figure 4:
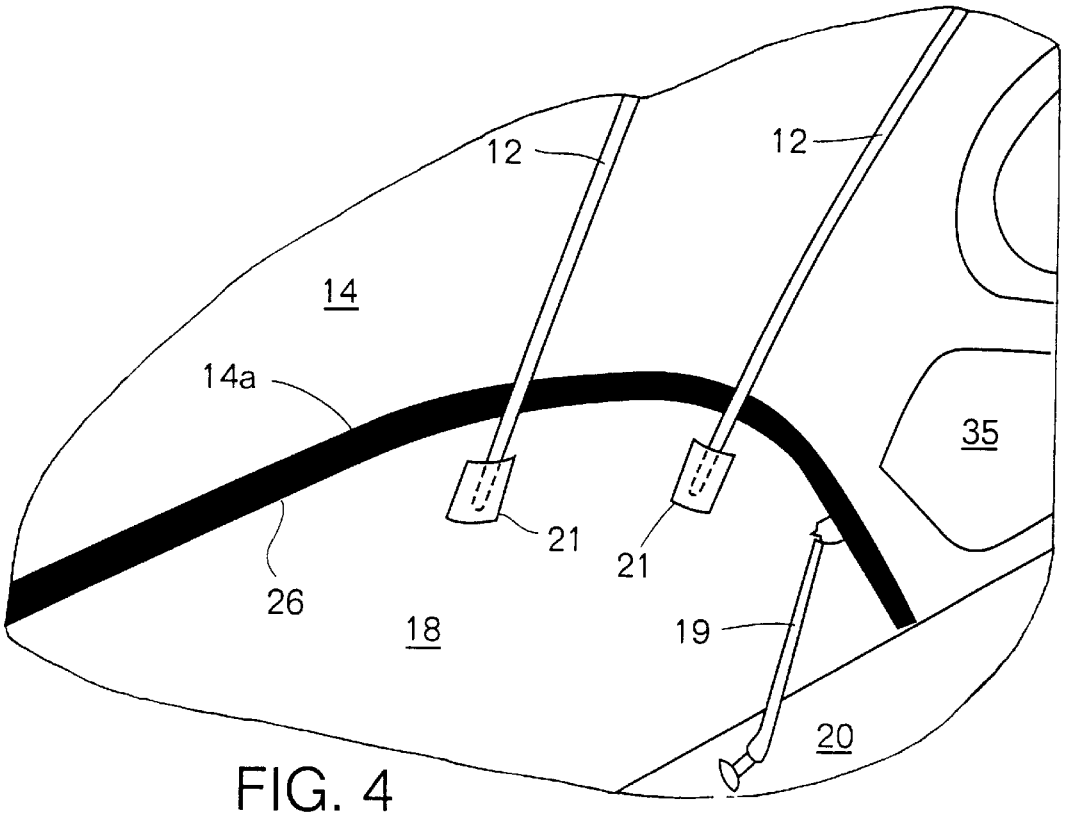
FIG. 4 illustrates the engagement of the upper ends of the camper back strut members to the awning of a boat in accordance with of the present invention.
Figure 12:
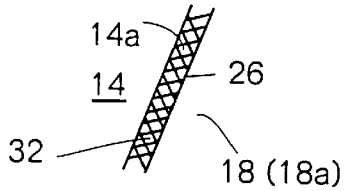
FIG. 12 is an enlarged view illustrating the securing of the cover portion by hook fastening members to the awning in accordance with the present invention.
Figure 13:
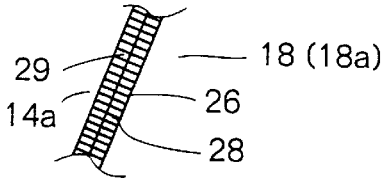
FIG. 13 is an enlarged view illustrating the securing of the cover portion by a zipper member to the awning in accordance with the present invention.
Figure 14:
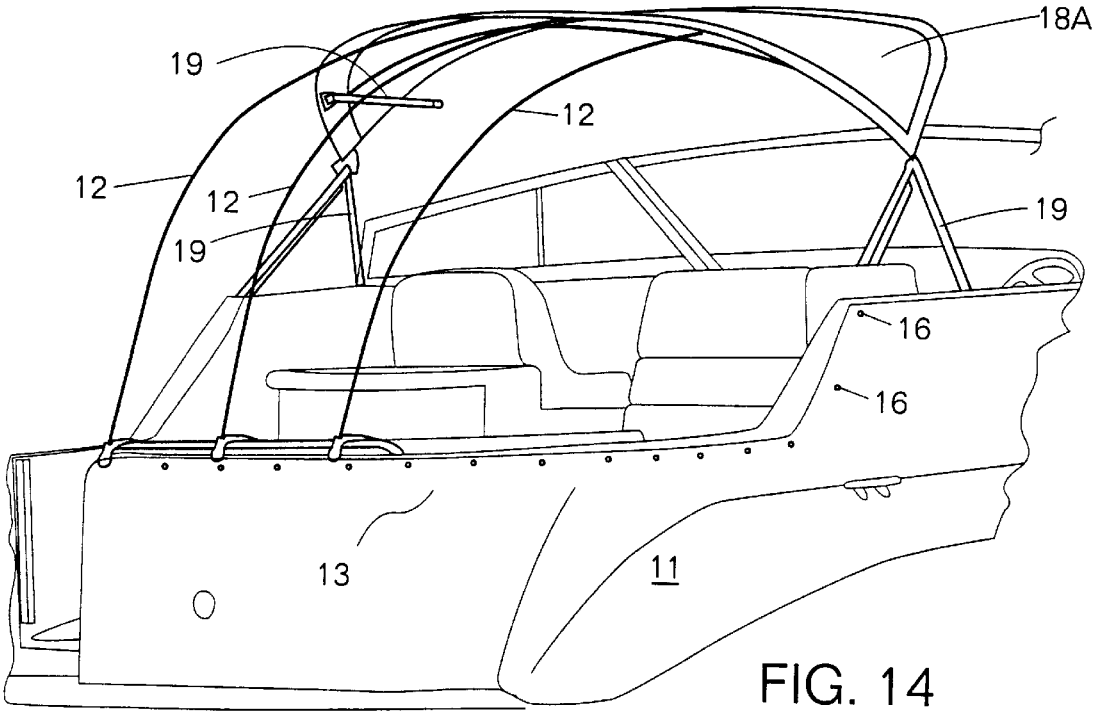
FIG. 14 is a perspective view illustrating the engagement of the camper back strut members with an awning member in accordance with the present invention.

As shown in FIG. 4, the support struts 12 are anchored to the rear edge 26 of the bimini awning 18 by resting in pockets 21 in the bimini awning 18. In FIG. 14, the support struts 12 are anchored to the awning 18A by resting in pockets 21 therein, in the same manner as shown in FIG. 4. In such an embodiment, the boat hull 11 may not include a radar or support arch 20 but does include awning support members 19. The rear edge 26 of the bimini awning 18 or awning 18A, preferably includes a zipper member 26 (FIG. 13) which is structurally arranged to cooperate with and to engage a corresponding zipper member 29 on the upper edge 14*a* of the covering portion to secure the covering portion to the awning. In an alternative embodiment, the rear edge 26 of the bimini awning 18 or awning 18A and the front edge 14*a* of the cover portion may include cooperating hook and fastener members 32 (FIG. 12).

Figure 5:
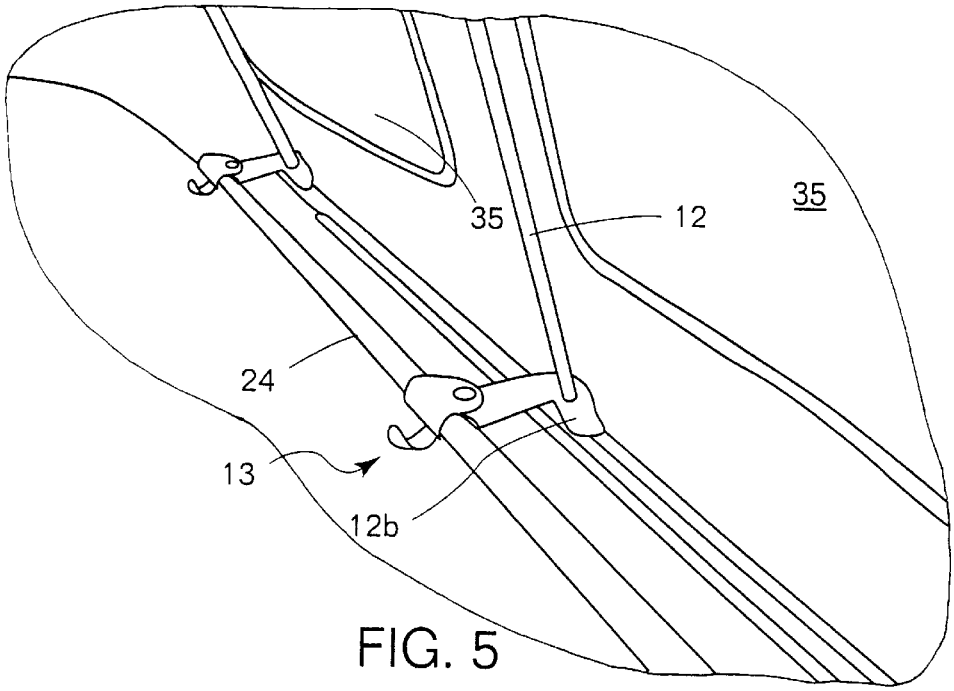
FIG. 5 is an view illustrating the anchoring of the lower ends of the camper back strut members to the rear handrail portion of a boat transom in accordance with the present invention.
Figure 6:
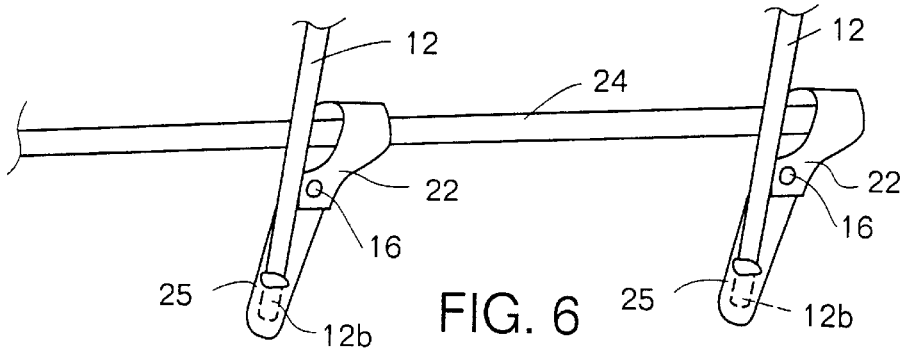
FIG. 6 is an rear perspective view showing the anchoring of the lower ends of the camper back strut members in pockets in the strap members which are releaseably secured to the rear handrail of a boat transom in accordance with the present invention.

As shown in FIGS. 5 and 6, the lower end 12*b* of the support strut members 12 may be adapted to be mounted to the boat transom 13 by a flexible member 22 which is adapted to engage a handrail 24 that is mounted on the transom of the boat 11. The flexible member 22 is mounted by a snap member 16 (FIG. 6) to the boat rail 24 and includes a pocket portion 25 which is adapted to receive the lower end 12*b* of the support members 12. Thus, the lower end 12*b* of the support members is mounted by a flexible member 22 to the boat railing of the transom of the boat and the upper end 12*a* of the support or strut members 12 may be mounted within pocket 21 on the bimini awning 18 or awning 18A. As partially shown in FIGS. 3 and 14, three support strut members 12 are mounted to the transom of the boat and are arcuately positioned upwardly to engage the pockets in the awnings 18 or 18A (FIGS. 2, 4 and 14).

Figure 9:
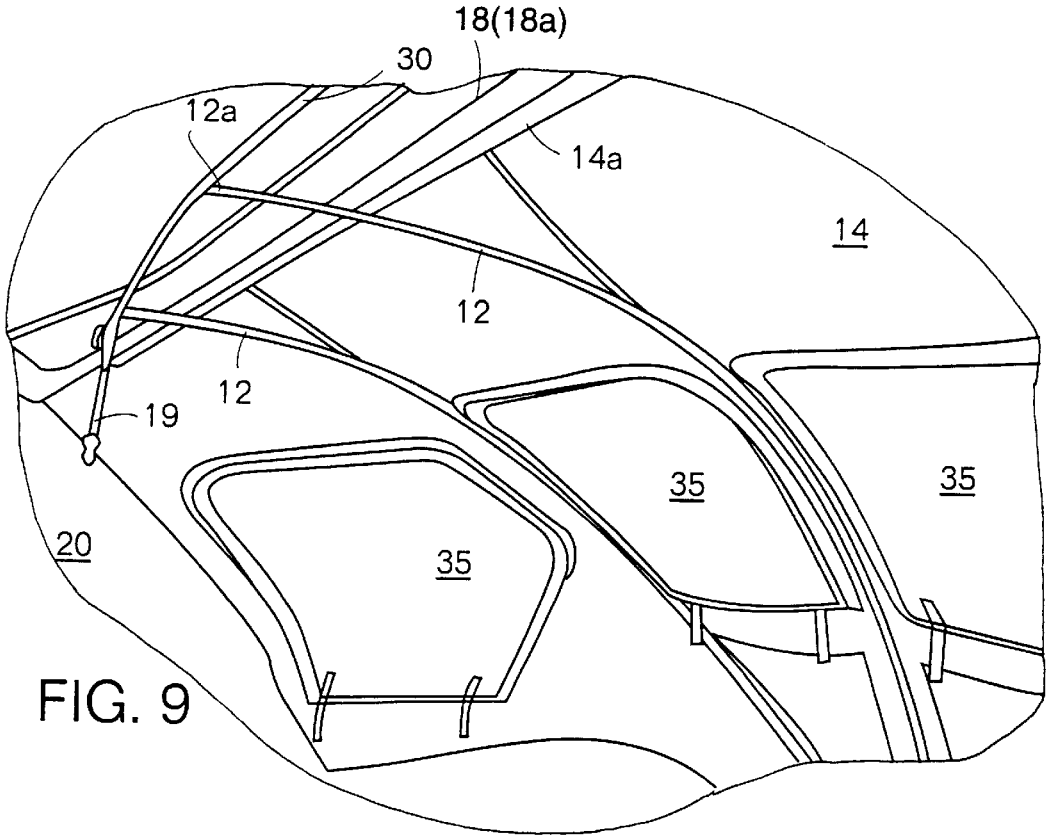
FIG. 9 is a perspective view illustrating the attachment of the camper back strut members to an auxiliary support frame member mounted to the awning support member in accordance with the present invention.

One alternative embodiment for the mounting of the upper ends 12*a* of the support strut members 12 to the pockets 21 in the awnings include the utilization of an auxiliary support member 30, which is mounted to the awning hardware 19, and which extends across the width of the boat substantially under the rear edge of the awning 18, the configuration as shown in FIG. 9. FIG. 10 is a cross-sectional view illustrating that the auxiliary support member 30 includes openings 34 which are adapted to permit the upper end 12*a* of the strut members 12 to fit within the openings in the auxiliary support member to thereby anchor the upper ends of the strut members. In this embodiment of the present invention, the upper edge 14*a* of the canvas covering 14 is also attached to the trailing edge of the awning 18, as previously described. This attachment may be made by a zipper members 28 and 29 (FIG. 13) or by a hook and fastener members 32 (FIG. 12).

A further means of attachment of the upper edge of the canvas covering 14 to the boat is the positioning of pockets 21, as shown in FIG. 4, on the front inside surface 14*a* the covering 14. The pockets 21 are adapted to receive the upper ends 12*a* of the strut members 12 to anchor the same, as shown in FIG. 4. The edge of the covering 14 is then attached directly to the radar arch or arch support 20, by snap members 16, as shown in FIG. 2.

Figure 8:
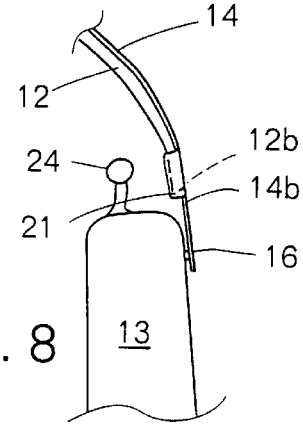
FIG. 8 is a cross-sectional view illustrating the anchoring of the lower ends of the camper back strut members to the boat transom in accordance with the present invention.

The lower edge 14*b* of the canvas covering 14 may also include pockets 21 therein which receive and anchor the lower end 12*b* of the struts 12. The covering 14 is secured to the transom 13 by snap members 16, as shown in FIG. 8. Thus, the canvas covering itself may provide the means for attachment of the struts to the boat without the necessity of any supplemental hardware.

The camper back assembly 10 includes a plurality of windows 35 (FIG. 9) therein which permits the occupant of the boat to have visibility out of the camper back assembly and also protects the occupant of the boat from inclement weather. The windows are preferably comprised of a flexible synthetic clear material with the side windows also being comprised of a flexible clear windows. However, it is within the scope of the present invention that the windows may include a screen material which permits ventilation through the camper back assembly.

Figure 7:
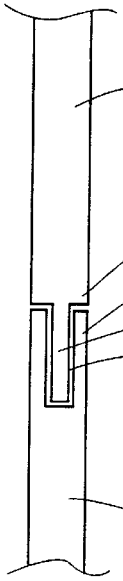
FIG. 7 is a cross-sectional view illustrating the interlocking and nesting of the camper back strut members in accordance with the present invention.

As shown in FIGS. 2, 3 and 9, the support members 12 are anchored at their upper ends 12*a* and at their lower ends 12*b* to either the awning 18 or to the auxiliary support member 30. The strut members 12 have a length greater than the planar distance between the upper anchor pocket 21 and the lower pocket portion 21 associated with the boat transom. Such a structure results in an outward arcuate dome support configuration by the strut members. Thus, when the canvas covering is positioned over the struts and attached to the transom and the sides and to the awning, the subsequent dome-shaped camper back permits the occupants of the boat to stand upright while being protected from inclement weather. As shown in FIG. 2, the strut members 12 may be of any predetermined length which determines the amount of arch necessary to provide the desired clearance for the occupants of the boat while simultaneously providing support for the canvas portion. Also, the struts 12 may be segmented and be comprised of a plurality of lengths which may be engaged to one another with one end 36 of the strut member having a recess 37 and the adjoining end 38 having a projection 39 such that the struts interlock and nest with one another, as shown in FIG. 7. Moreover, the struts 12 may alternatively be attachable to the bow of the boat with a similar configuration, thereby providing shelter and added use to additional portions of the boat.

The present camper back assembly requires significantly less time in assembling the camper back assembly to a boat. The entire camper back assembly may be stored in a gym bag which permits significant savings of boat storage space. Additionally, the present camper back assembly is less costly, easier to store and permits easy assembly without compromise to head-room of the occupant during usage. Additionally, when the camper back assembly is not attached to the boat, the occupants of the boat are free to move about the boat without interference with permanent hardware secured to the boat.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

What is claimed is:

1. A camper assembly arranged for attachment to a boat having integral supporting structure extending thereacross between the sides of the boat, the assembly including in combination:

a plurality of flexible strut members secured together and each having a first end structurally arranged to be secured to a boat surface and a second end opposite said first end structurally arranged to be secured to the integral supporting structure of the boat, and wherein the length of said strut members is greater than the linear distance between the boat surface and the supporting structure securing point to provide dome shaped, upwardly bowed strut members; and a cover portion structurally arranged to be supported by said strut members and structurally arranged to be releaseably secured to the supporting structure and to the boat surface, to provide a dome shaped camper assembly.

2. The camper assembly in accordance with claim 1, wherein said plurality of said strut members include at least three strut members.

3. The camper assembly in accordance with claim 1, wherein said strut members are segmented, with the ends of each segment being structurally arranged to nest with respect to one another.

4. The camper assembly in accordance with claim 1 wherein said cover portion includes pockets which engage said first ends of said strut members and which are structurally arranged to receive and anchor said second end opposite the one end of said strut members.

5. The camper assembly in accordance with claim 4, wherein said pockets of said cover portion further include strap members which are arranged to engage the boat surface to secure said first ends of said strut members to the boat surface.

6. The camper assembly in accordance with claim 1, wherein said cover portion includes windows therein made of a clear plastic material.

7. The camper assembly in accordance with claim 1, wherein said cover portion is comprised of a water repellant material.

8. The camper assembly in accordance with claim 1, wherein said cover portion includes a screen material portion which permits ventilation of the dome shaped camper assembly.

9. The camper assembly in accordance with claim 1, further including a bag member adapted to receive and store said plurality of strut members and said cover portion.

10. The camper assembly in accordance with claim 1, wherein said strut members are collapsible to permit storage of the camper assembly in a bag.

11. A camper strut assembly frame arranged for attachment to a boat having a windshield supporting structure extending thereacross, said strut assembly frame including a plurality of flexible strut members secured together and each having a first end arranged to be releaseably anchored to a boat surface of the boat and a second end opposite said first end structurally arranged to be secured to the windshield supporting structure, and wherein the length of each of said strut members is greater than the linear distance between the boat surface and the windshield anchoring point to provide a dome shaped, upwardly bowed strut assembly frame.

12. A camper strut assembly frame arranged for attachment to a boat having a supporting structure extending thereacross between the sides of the boat, said strut assembly frame including a plurality of flexible strut members secured together and each having a first end arranged to be releaseably anchored to a boat surface of the boat and a second end opposite said first end arranged to be secured to the supporting structure, and wherein the length of each of said strut members is greater than the linear distance between the boat surface and the supporting structure anchoring point to provide a dome shaped, upwardly bowed strut assembly frame.

* * * * *